US010332660B2

(12) United States Patent
Lee et al.

(10) Patent No.: US 10,332,660 B2
(45) Date of Patent: Jun. 25, 2019

(54) RESISTOR ELEMENT

(71) Applicant: SAMSUNG ELECTRO-MECHANICS CO., LTD., Suwon-si, Gyeonggi-do (KR)

(72) Inventors: Jong Pil Lee, Suwon-si (KR); Seung Woo Song, Suwon-si (KR); Ji Hyun Park, Suwon-si (KR); Jong Bong Lim, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/680,663

(22) Filed: Aug. 18, 2017

(65) Prior Publication Data

US 2018/0144848 A1 May 24, 2018

(30) Foreign Application Priority Data

Nov. 23, 2016 (KR) ..... 10-2016-0156152

(51) Int. Cl.
*H01C 1/148* (2006.01)
*H01C 1/14* (2006.01)
(Continued)

(52) U.S. Cl.
CPC ..... *H01C 1/14* (2013.01); *H01C 1/01* (2013.01); *H01C 1/148* (2013.01); *H01C 7/003* (2013.01);
(Continued)

(58) Field of Classification Search
CPC ..... H01C 1/14; H01C 1/01; H01C 17/06
(Continued)

(56) References Cited

U.S. PATENT DOCUMENTS 4,486,738 A * 12/1984 Sadlo ..... H01C 17/006 219/543
5,258,738 A * 11/1993 Schat ..... H01C 1/144 338/20
(Continued)

FOREIGN PATENT DOCUMENTS

CN 1672222 A 9/2005
CN 102623115 A 8/2012
(Continued)

OTHER PUBLICATIONS

Notice of Reason for Rejection issued in Korean Patent Application No. 10-2016-0156152, dated Jul. 18, 2018 (English translation).
(Continued)

*Primary Examiner* — Kyung S Lee
(74) *Attorney, Agent, or Firm* — Morgan Lewis & Bockius LLP

(57) ABSTRACT

A resistor element includes a substrate having first and second surfaces facing each other, and a plurality of side surfaces connecting the first surface and the second surface with each other. A resistance layer is on at least one of the first and second surfaces. A first terminal and a second terminal are connected to the resistance layer, and each include a first electrode layer on the first surface, a second electrode layer on the second surface, and a plurality of side electrode layers on at least a portion of the plurality of side surfaces. At least a portion of the side surfaces of the substrate is exposed between side electrode layers of the first terminal.

20 Claims, 10 Drawing Sheets

(51) Int. Cl.

| | |
|---|---|
| ***H01C 1/01*** | (2006.01) |
| ***H01C 17/06*** | (2006.01) |
| ***H01C 7/00*** | (2006.01) |
| ***H01C 17/00*** | (2006.01) |
| ***H01C 17/28*** | (2006.01) |

(52) U.S. Cl.
CPC ..... *H01C 17/006* (2013.01); *H01C 17/06* (2013.01); *H01C 17/281* (2013.01)

(58) Field of Classification Search
USPC ..... 338/332
See application file for complete search history.

(56) References Cited

U.S. PATENT DOCUMENTS 5,331,305 A * 7/1994 Kanbara ..... H01C 1/14 338/305
5,548,269 A * 8/1996 Katsuno ..... H01C 1/148 338/195
5,844,468 A * 12/1998 Doi ..... H01C 1/144 338/260
6,005,474 A * 12/1999 Takeuchi ..... H01C 1/142 29/620
7,154,373 B2 * 12/2006 Kobayashi ..... H01C 1/01 338/320
7,609,143 B2 * 10/2009 Huang ..... H01C 1/148 29/619
7,755,468 B2 * 7/2010 Tsukada ..... H01C 1/144 338/195
8,284,016 B2 * 10/2012 Ryu ..... H01C 1/034 338/307
8,482,373 B1 * 7/2013 Tseng ..... H01C 7/13 338/20
9,307,646 B2 * 4/2016 Tseng ..... H05K 1/181
2004/0022001 A1 2/2004 Chu
2005/0266615 A1 12/2005 Tsukada

FOREIGN PATENT DOCUMENTS

| | | | |
|---|---|---|---|
| CN | 202816523 | U | 3/2013 |
| CN | 103578672 | A | 2/2014 |
| DE | 299 09 889 | U1 | 12/1999 |
| JP | H02-135702 | A | 5/1990 |
| JP | 06-053004 | A | 2/1994 |
| JP | 07-183108 | A | 7/1995 |
| JP | H11-195531 | A | 7/1999 |
| JP | 2002-289463 | A | 10/2002 |
| KR | 10-2012-0048353 | A | 5/2012 |

OTHER PUBLICATIONS

Office Action issued in corresponding Chinese Patent Application No. 201711087747.5 dated Jan. 22, 2019, with English translation.

* cited by examiner

RESISTOR ELEMENT

CROSS-REFERENCE TO RELATED APPLICATION(S)

This application claims the benefits under 35 USC 119 (a) of Korean Patent Application No. 10-2016-0156152, filed on Nov. 23, 2016 in the Korean Intellectual Property Office, the entire disclosure of which are incorporated herein by reference for all purposes.

BACKGROUND

1. Field

The following description relates to a resistor element.

2. Description of Related Art

A resistor element in a chip shape is suitable for implementing a precise resistor, and serves to adjust a current and to drop a voltage within an electronic circuit.

As electronic devices have recently been down-sized and refined, the size of the electronic circuits used in the electronic devices has gradually been miniaturized. Accordingly, the size of the resistor element has also gradually been miniaturized. In order to save costs and time related to the production of the resistor elements, various methods for reducing the number of manufacturing operations needed to produce the resistor elements have recently been proposed.

SUMMARY

An aspect of the present disclosure may provide a resistor element capable of reducing the number of manufacturing operations of the resistor element to efficiently produce the resistor element.

According to an aspect of the present disclosure, a resistor element may include a substrate having first and second surfaces facing each other, and a plurality of side surfaces connecting the first surface and the second surface with each other. A resistance layer is on at least one of the first and second surfaces. First and second terminals are connected to the resistance layer, and each include an upper electrode layer on the first surface, a lower electrode layer on the second surface, and a plurality of side electrode layers on at least a portion of the plurality of side surfaces. At least a portion of the side surfaces of the substrate is exposed between side electrode layers of the first terminal.

According to another aspect of the present disclosure, a resistor element may include a substrate having first and second surfaces facing each other, and a plurality of side surfaces connecting the first surface and the second surface with each other. First and second terminals each include an upper electrode layer on the first surface, a lower electrode layer on the second surface, and side electrode layers only on first side surfaces having a curved shape, among the plurality of side surfaces, to electrically connect the first electrode layer and the second electrode layer with each other. A resistance layer is on at least one of the first and second surfaces so as to be connected to the first terminal and the second terminal. There are no electrode layers on first side surfaces that do not have a curved shape, of the plurality of side surfaces.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments of the following description will now be described in detail with reference to the accompanying drawings.

Figure 1:
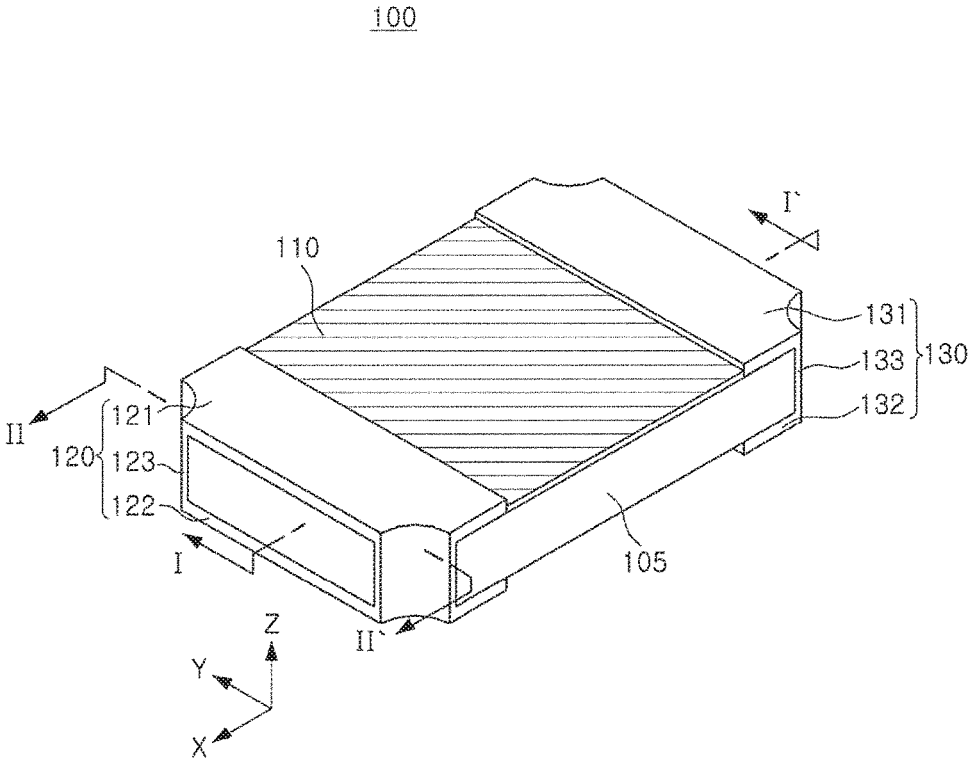
FIG. 1 is a perspective view illustrating a resistor element according to an exemplary embodiment.
Figure 2:
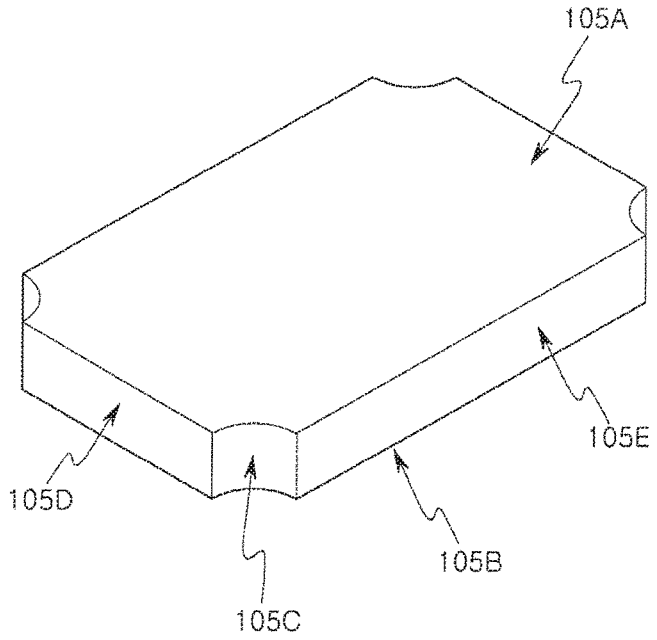
FIG. 2 is a perspective view illustrating a substrate included in the resistor element of the exemplary embodiment illustrated in FIG. 1.

FIG. 1 is a perspective view illustrating a resistor element according to an exemplary embodiment. FIG. 2 is a perspective view illustrating a substrate included in the resistor element of the exemplary embodiment illustrated in FIG. 1.

Referring to FIG. 1, a resistor element 100 may include a substrate 105, a resistance layer 110, and first and second terminals 120 and 130.

FIG. 2 illustrates the substrate 105. The substrate 105 may include a first surface 105A, a second surface 105B opposing each other, and a plurality of side surfaces 105C, 105D, and 105E. The plurality of side surfaces 105C, 105D, and 105E may include a first side 105C having a curved shape, and second and third sides 105D 105E having planar shapes. In the exemplary embodiment illustrated in FIG. 2, the first side 105C is illustrated as being curved inwardly into the substrate 105, but is not necessarily limited thereto. There may be four first sides 105C at the corners of the substrate 105, two second sides 105D on opposing sides of the substrate, and two third sides 105E on opposing sides of the substrate.

The second and third sides 105D and 105E may each be disposed between first sides 105C. That is, opposing ends of second sides 105D may be connected to first sides 105C, and opposing ends of third sides 105E may also be connected to first sides 105C. The first sides 105C may each have a relatively smaller area than each of the second sides 105D and each of the third sides 105E. The second sides 105D may each have a different area from each of the third sides 105E. In the exemplary embodiment illustrated in FIG. 2, the area of each of the second sides 105D are smaller than the area of each of the third sides 105E.

The substrate 105 may have a plate shape having a predetermined thickness, and may include a material that may efficiently discharge heat generated by the resistance layer 110. The substrate 105 may include a ceramic such as alumina ($Al_2O_3$) or a polymer material. The substrate 105 may be an alumina substrate obtained by anodizing a surface of aluminum.

In the resistor element 100 according to an exemplary embodiment, the resistance layer 110 may be formed on at least one of the first surface 105A and the second surface 105B. Although FIG. 1 illustrates the resistance layer 110 on the first surface 105A, the resistance layer 110 may also be formed only on the second surface 105B, or on both the first surface 105A and the second surface 105B. The resistance layer 110 may be electrically connected to a first terminal 120 and a second terminal 130 at opposing ends of the substrate 105 in a first direction (X axis direction). The resistance layer 110 may also have a region overlapping with the first terminal 120 and the second terminal 130 at opposing ends in the first direction.

The resistance layer 110 may include a metal, a metal alloy, or a metal oxide. As an example, the first resistance layer 110 may include at least one of a Cu—Ni based alloy, a Ni—Cu based alloy, a Ru oxide, a Si oxide, a Mn based alloy. The resistance layer 110 may be formed by coating and sintering a paste including the metal, the metal alloy, or the metal oxide onto the first surface 105A or the second surface 105B of the substrate 105 using a screen printing method, or the like.

The first terminal 120 and the second terminal 130 may be disposed to face each other in the first direction. The first terminal 120 and the second terminal 130 may be connected to the resistance layer 110, and may be formed of a metal such as a nickel (Ni), silver (Ag), copper (Cu), platinum (Pt), tin (Sn), chromium (Cr), or the like. The first terminal 120 may include a first electrode layer 121 formed on the first surface 105A, a second electrode layer 122 formed on the second surface 105B, and side electrode layers 123.

Referring to FIGS. 1 and 2, the second side surface 105D may be exposed between the side electrode layers 123 included in the first terminal 120. That is, the side electrode layers 123 included in the first terminal 120 may be formed only on first side surfaces 105C. Accordingly, the second side surface 105D may be exposed through the first terminal 120. The first electrode layer 121 and the second electrode layer 122 may have the second side surface 105D exposed therebetween, and may be electrically connected to each other by the side electrode layers 123. This structure may be formed by a manufacturing operation of forming the first electrode layer 121 and the second electrode layer 122 together with the side electrode layers 123, as described below. According to an exemplary embodiment, the first terminal 120 may be formed to outwardly protrude from the second side surface 105D.

Figure 3:
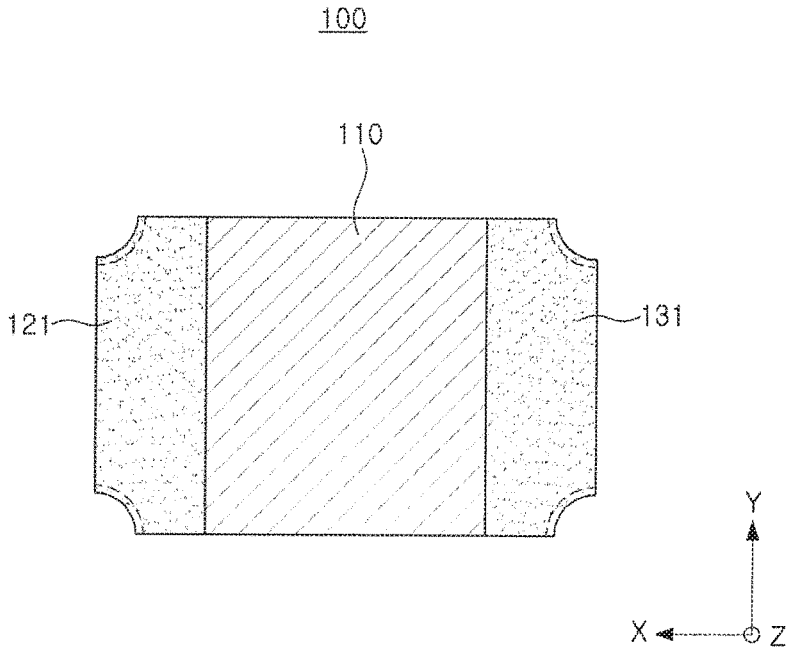
FIG. 3 is a plan view illustrating the resistor element of the exemplary embodiment illustrated in FIG. 1.

FIG. 3 is a plan view illustrating the resistor element of the exemplary embodiment illustrated in FIG. 1.

Referring to FIG. 3, the resistance layer 110 may substantially cover the entirety of the first surface 105A between the terminals. The resistance layer 110 may be directly in contact with the first electrode layer 121 of the first terminal 120 and the first electrode layer 131 of the second terminal 130 at opposing ends of the resistance layer 110 in the first direction. Therefore, a current generated by a potential difference between the first terminal 120 and the second terminal 130 may flow through the resistance layer 110.

Figure 4:
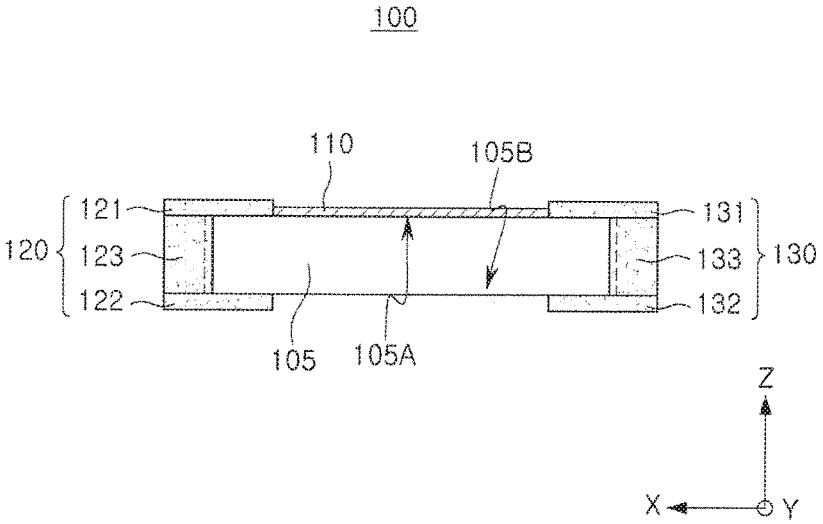
FIG. 4 is a side view illustrating the resistor element of the exemplary embodiment illustrated in FIG. 1.
Figure 5:
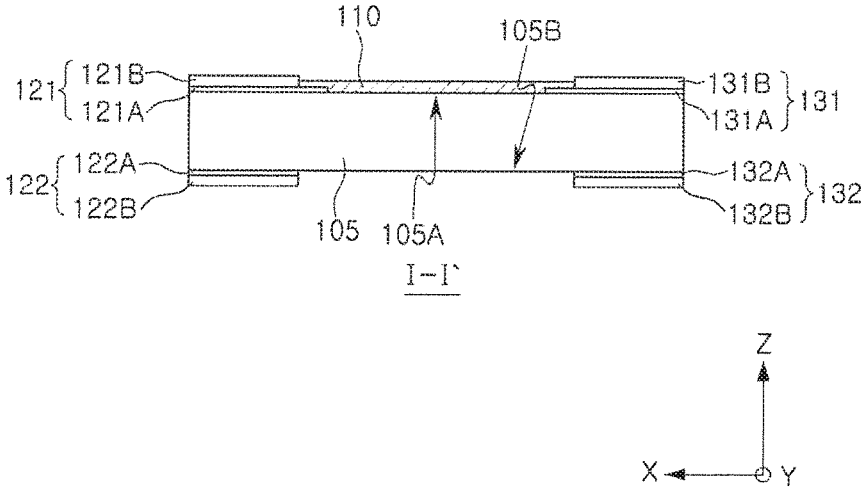
FIG. 5 is a cross-sectional view illustrating a cross section taken along a direction I-I' of the resistor element the exemplary embodiment illustrated in FIG. 1.

FIG. 4 is a side view illustrating the resistor element of the exemplary embodiment illustrated in FIG. 1. FIG. 5 is a cross-sectional view illustrating a cross section taken along a direction I-I' of the resistor element of the exemplary embodiment illustrated in FIG. 1.

Referring to FIGS. 4 and 5, the resistance layer 110 may be formed on the first surface 105A of the substrate 105. In this case, when the resistor element 100 is mounted on the circuit board, the second surface 105E may be disposed to be closer to the circuit board than the first surface 105A. The second electrode layers 122 and 132 of the resistor element 100 may be directly connected to pads of the circuit board by solder bumps, or the like.

The first terminal 120 and the second terminal 130 may each include internal electrode layers and external electrode layers. Referring to FIG. 5, the first electrode layer 121 of the first terminal 120 may include a first internal electrode layer 121A and a first external electrode layer 121B. The second electrode layer 122 of the first terminal 120 may include a second internal electrode layer 122E and a second external electrode layer 122B. The first electrode layer 131 of the second terminal 130 may include a first internal electrode layer 131A and a first external electrode layer 131B, and the second electrode layer 132 of the second terminal 130 may include a second internal electrode layer 132A and a second external electrode layer 132B.

The internal electrode layers 121A, 122A, 131A, and 132A may be provided as a seed layer for forming the external electrode layers 121B, 122B, 131B, and 132B. The internal electrode layers 121A, 122A, 131A, and 132A may be formed by using a sputtering operation. The external electrode layers 121B, 122B, 131B, and 132B may be formed by a plating operation in which the internal electrode layers 121A, 122A, 131A, and 132A are used as the seed layer. At least some of the external electrode layers 121B, 122B, 131B, and 132B may also have a plurality of layers formed of different metal materials.

Figure 6:
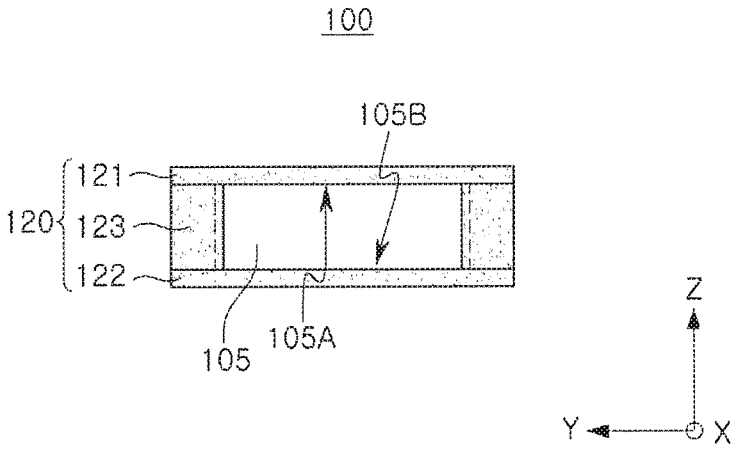
FIG. 6 is a front view illustrating the resistor element of the exemplary embodiment illustrated in FIG. 1.
Figure 7:
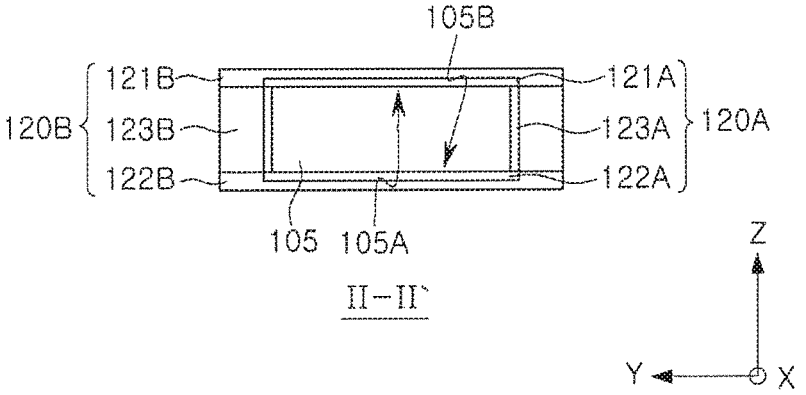
FIG. 7 is a cross-sectional view illustrating a cross section taken along a direction II-II' of the resistor element of the exemplary embodiment illustrated in FIG. 1.

FIG. 6 is a front view illustrating the resistor element of the exemplary embodiment illustrated in FIG. 1. FIG. 7 is a cross-sectional view illustrating a cross section taken along a direction II-II' of the resistor element of the exemplary embodiment illustrated in FIG. 1.

Referring to FIGS. 6 and 7, a portion of the substrate 105 may be exposed within the first terminal 120. The first terminal 120 may include the first electrode layer 121 formed on the first surface 105A, the second electrode layer 122 formed on the second surface 105B, and the side electrodes 123 electrically connecting the first electrode layer 121 and the second electrode layer 122 with each other. Referring to FIG. 6, a portion of the substrate 105 may be exposed between the side electrode layers 123.

Referring to FIG. 7, the first electrode 121, the second electrode layer 122, and the side electrode layers 123 included in the first terminal 120 may each include the internal electrode layer 120A and the external electrode layer 120B. The internal electrode layer 120A may be formed on the substrate 105, and may be formed by a sputtering operation, or the like. When the internal electrode layer 120A is formed, a side internal electrode layer 123A may be formed simultaneously in an operation of forming the first internal electrode layer 121A or the second internal electrode layer 122A. The external electrode layer 120B may be formed by a plating operation in which the internal electrode layer 120A is used as a seed layer.

Figure 8:
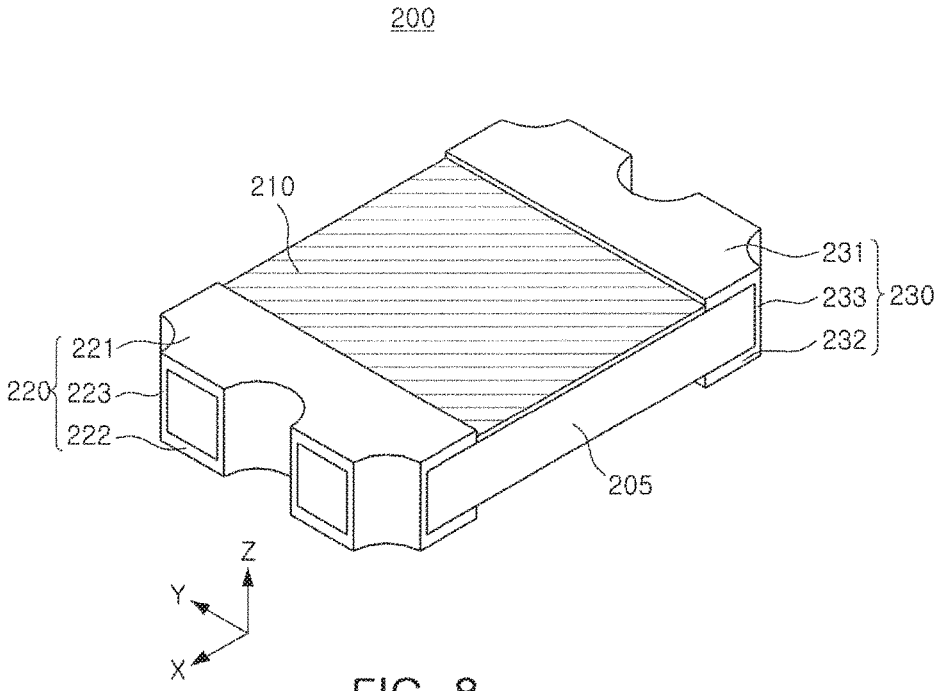
FIG. 8 is a perspective view illustrating a resistor element according to an exemplary embodiment.

FIG. 8 is a perspective view illustrating a resistor element according to an exemplary embodiment.

Referring to FIG. 8, a resistor element 200 according to an exemplary embodiment may include a substrate 205, a resistance layer 210, and first and second terminals 220 and 230.

In FIG. 8, the first terminal 220 may include a first electrode layer 221, a second electrode layer 222, and side electrode layers 223 connecting the first electrode layer 221 and the second electrode layer 222 with each other. The side electrode layers 223 may be separated from each other, and a portion of the substrate 205 may be exposed between the side electrode layers 223. The first terminal 220 may include three side electrode layers 223. Therefore, a current transfer path between the first electrode layer 221 and the second electrode layer 222 may be efficiently secured. Meanwhile, since the three side electrode layers 223 exist, the substrate 205 may be exposed in two regions separated from each other by the first terminal 220.

Figure 9:
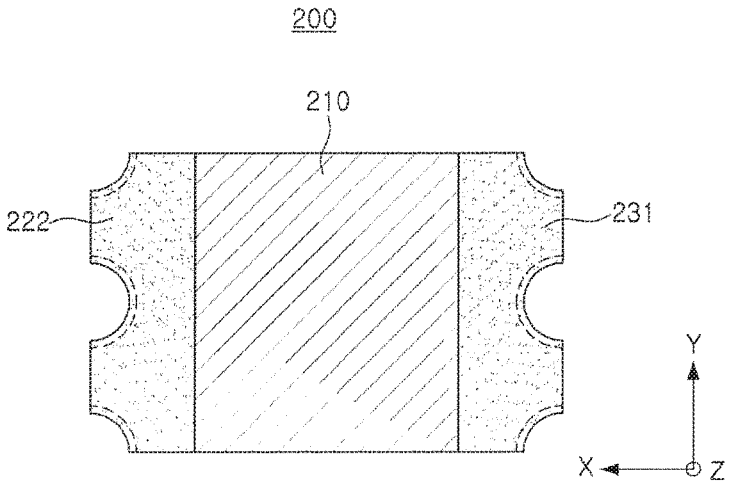
FIG. 9 is a plan view illustrating the resistor element of the exemplary embodiment illustrated in FIG. 8.
Figure 10:
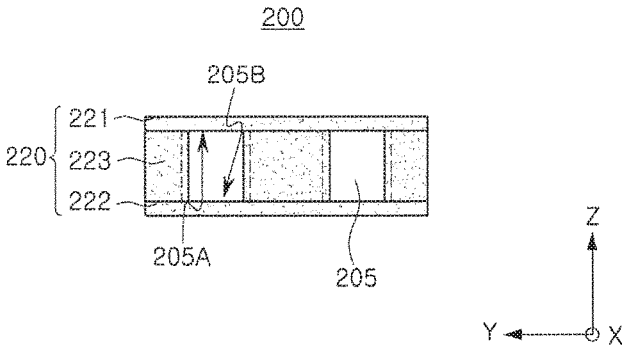
FIG. 10 is a front view illustrating the resistor element of the exemplary embodiment illustrated in FIG. 8.

FIG. 9 is a plan view illustrating the resistor element of the exemplary embodiment illustrated in FIG. 8 and FIG. 10 is a front view illustrating the resistor element of the exemplary embodiment illustrated in FIG. 8.

Referring to FIGS. 9 and 10, the first terminal 220 may include a first electrode layer 221 formed on the first surface 205A of the substrate 205, and a second electrode layer 222 formed on the second surface 205B of the substrate 205. The first electrode layer 221 and the second electrode layer 222 may be formed to face each other and be parallel with each other, and may be connected to each other by the side electrode layers 223.

The side electrode layers 223 may be separated from each other in a second direction (Y axis direction), and a portion of the substrate 205 may be exposed between the side electrode layers 223. Therefore, heat generated in the resistor element 200 during the operation may be efficiently discharged.

Figure 11:
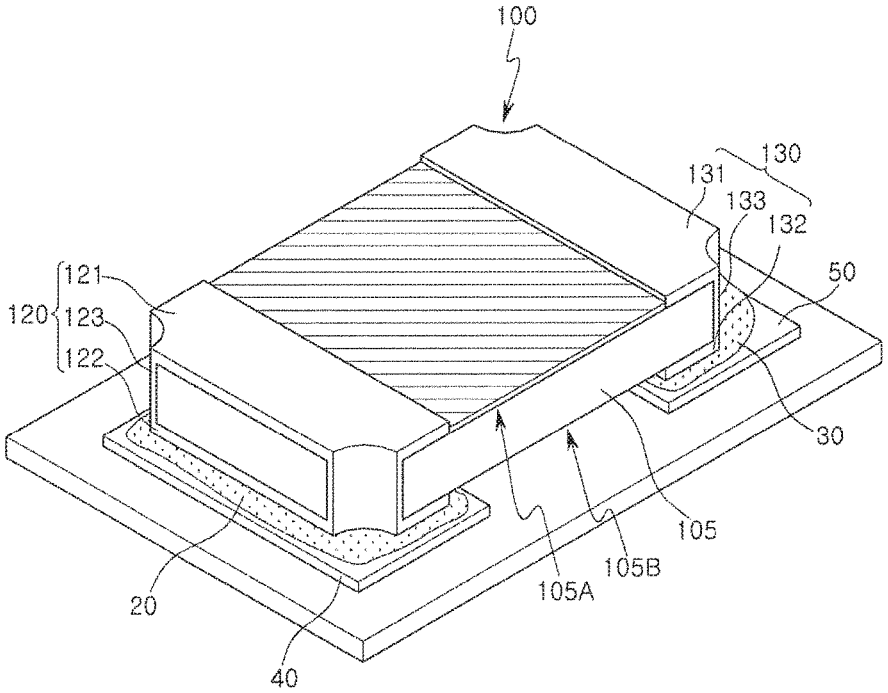
FIG. 11 is a perspective view illustrating a resistor element assembly including the resistor element according to the exemplary embodiment mounted on a circuit board.

FIG. 11 is a perspective view illustrating a resistor element assembly including the resistor element according to the exemplary embodiment mounted on a circuit board. Although FIG. 11 illustrates the resistor element 100 according to the exemplary embodiments described with reference to FIGS. through 7, the resistor element assembly is not necessarily limited thereto.

Referring to FIG. 11, the resistor element assembly may include a circuit board 10 on which the resistor element 100 is mounted. The circuit board 10 may include first and second electrode pads 40 and 50. The first and second electrode pads 40 and 50 may respectively be connected to the first terminal 120 and the second terminal 130 of the resistor element 100 by solder bumps 20 and 30. In order to increase adhesion with the solder bumps 20 and 30, the first terminal 120 and the second terminal 130 may include a tin (Sn) plated layer.

FIGS. 12 through 18 are views illustrating a method for manufacturing a resistor element according to an exemplary embodiment.

Figure 12:
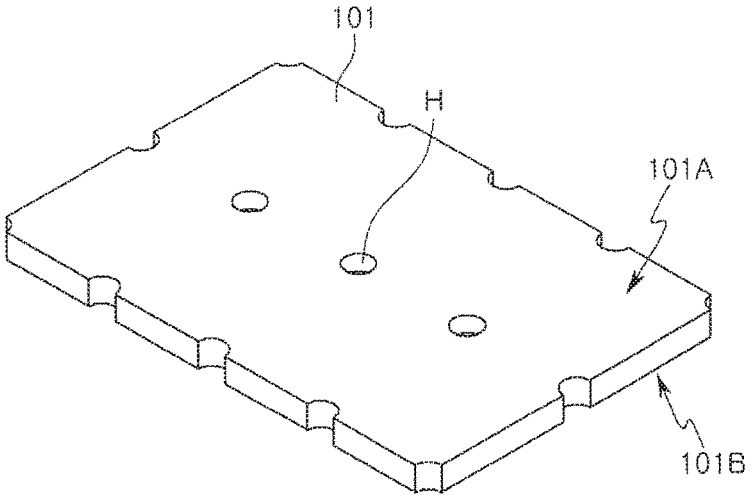
FIGS. 12 through 18 are views illustrating a method for manufacturing a resistor element according to an exemplary embodiment.

Referring to FIG. 12, a base substrate 101 may be provided. The base substrate 101 may have a first surface 101A and a second surface 101B facing the first surface 101A. A plurality of through-holes H penetrating through the base substrate 101 may be formed. The plurality of through-holes H may have various shapes such as a circle, an ellipse, and a polygon. The plurality of through-holes H may be disposed in a matrix form when being viewed from the first surface 101A of the base substrate 101.

Figure 13:
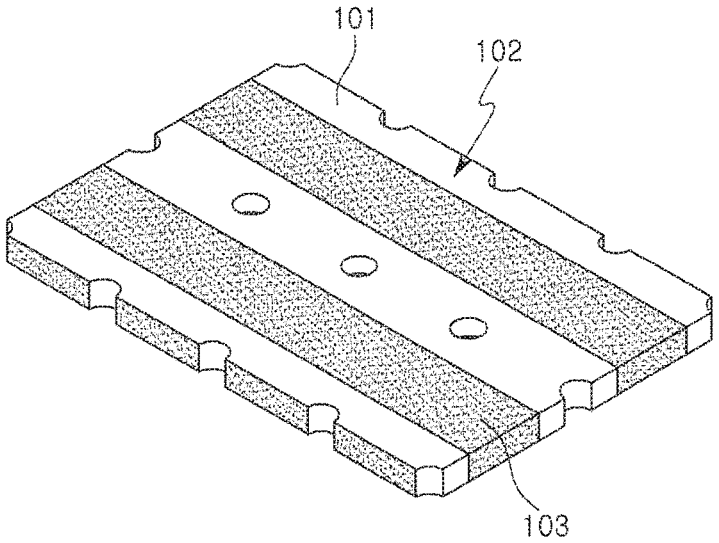

Referring to FIG. 13, a protection layer 103 may be formed on the base substrate 101. The protection layer 103 may be formed on the surface of the base substrate 101 other than the plurality of through-holes H. Referring to FIG. 13, a region where the protection layer 103 is not formed in the base substrate 101 may be defined as a first region 102. The first region 102 may include some regions of the first surface 101A and the second surface 101B of the base substrate 101, and inner surfaces of the plurality of through-holes H.

Figure 14:
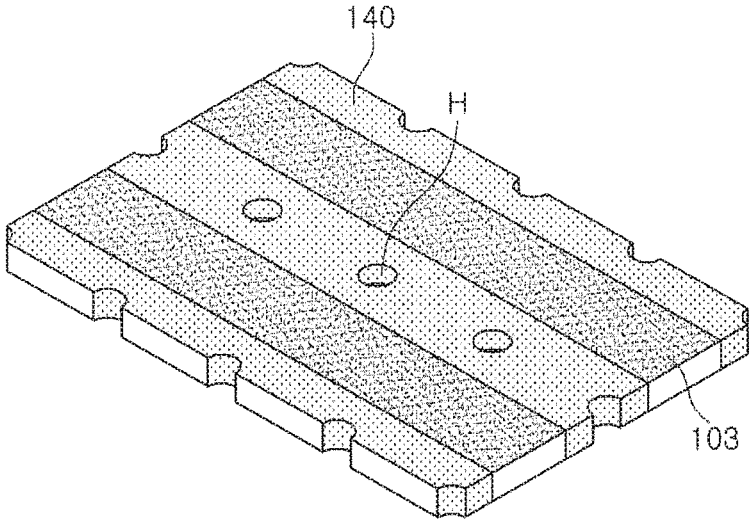
Figure 15:
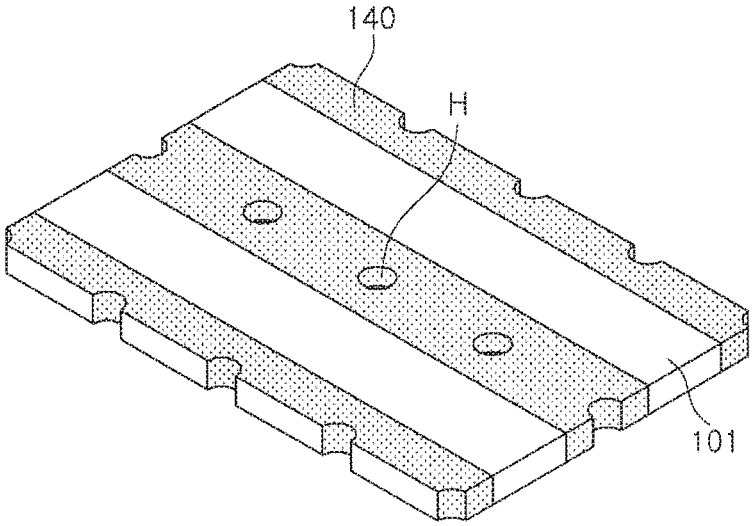

Referring to FIG. 14, a seed metal layer 140 may be formed of a metal, a metal compound, or a metal oxide in the first region 102 in which the protection layer 103 is not formed. The seed metal layer 140 may include at least one of metals such as silver (Ag), copper (Cu), nickel (Ni), platinum (Pt) and the like, and may be formed by a sputtering operation. The seed metal layer 140 may be formed not only on the first surface 101A and the second surface 101B of the base substrate 101 but also on the inner surfaces of the plurality of through-holes H in which the protection layer 103 is not formed. When forming the seed metal layer 140 on the first surface 101A and the second surface 101B by the sputtering operation, the seed metal layer 140 may be simultaneously formed in the plurality of through-holes H. When the formation of the seed metal layer 140 is completed, the protection layer 103 may be removed as illustrated in FIG. 15.

Figure 16:
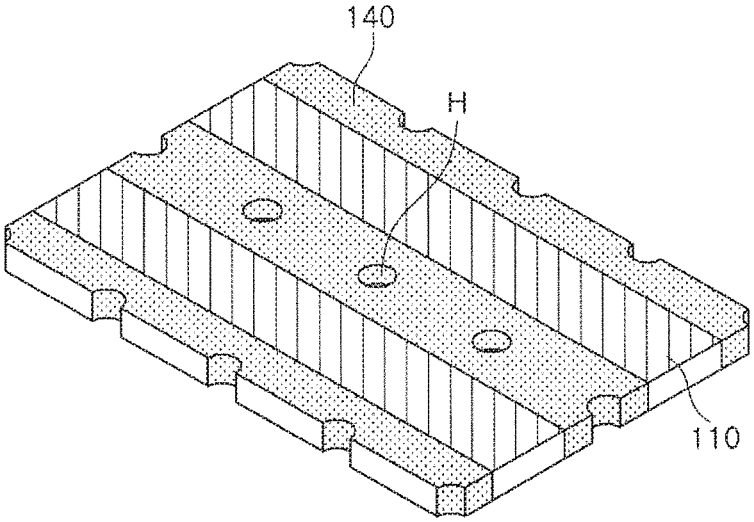

Referring to FIG. 16, a resistance layer 110 may be formed on at least a portion of the region from which the protection layer 103 is removed. The resistance layer 110 may be formed of at least one of a Cu—Ni based alloy, a Ni—Cr based alloy, a Ru oxide, a Si oxide, manganese (Mn), and a Mn based alloy, and may be formed by coating and sintering a pasting the above-mentioned material by a screen printing method, or the like.

The resistance layer 110 may be only formed on the first surface 101A and the second surface 101B of the base substrate 101. That is, in contrast to the protection layer 103 that is also formed on the side surfaces of the base substrate 101, the resistance layer 110 may be only formed on the first surface 101A and the second surface 101B corresponding to a top surface and a bottom surface of the base substrate 101. The resistance layer 110 may be formed to be connected to the internal metal layer 140 on the first surface 101A and the second surface 101B.

Figure 17:
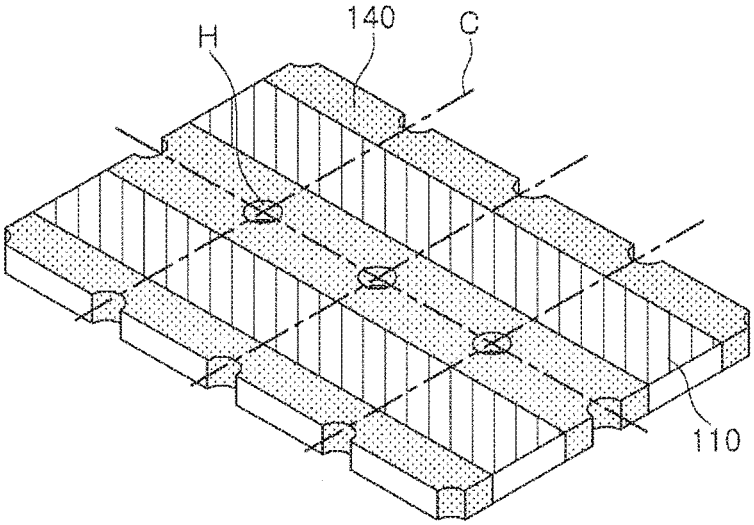
Figure 18:
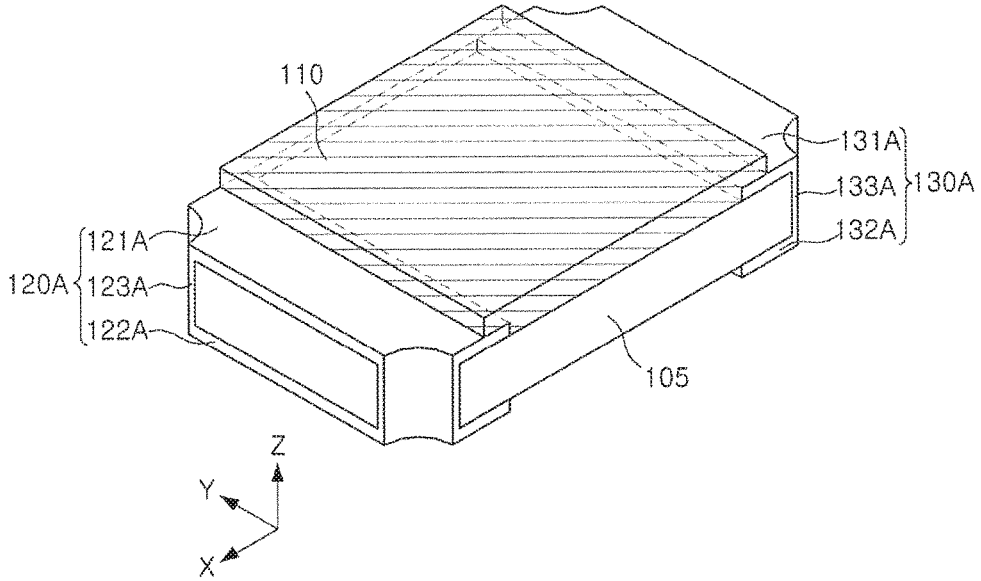

Referring to FIG. 17, the base substrate 101 may be divided into a plurality of unit elements along virtual lines C connecting the plurality of through-holes H to each other. The base substrate 101, the resistance layer 110, and the seed metal layer 140 may be divided into the plurality of unit elements by the dividing operation illustrated ire FIG. 17. Referring to FIG. 18, one unit element may include a substrate 105, a resistance layer 110, a first internal electrode 120A, and a second internal electrode 130A. The first internal electrode 120A and the second internal electrode 130A may be formed while the seed metal layer 140 is divided by the dividing operation.

Referring to FIG. 18, the first internal electrode 120A may include a first internal electrode layer 121A, a second internal electrode layer 122A, and a side internal electrode layer 123A. The first internal electrode layer 121A and the second internal electrode layer 122A may be each formed on the first surface 105A and the second surface 105B of the substrate 105, and the side internal electrode layer 123A may be formed on a portion of the side surface of the substrate 105. Since the side internal electrode layer 123A is formed only on the portion of the side surface of the substrate 105, the portion of the side surface of the substrate 105 may be exposed between the side internal electrode layer 123A and the first and second internal metal layers 121A and 122A.

The side internal metal layer 123A may be a region formed in the plurality of through-holes H, in the operation of forming the internal metal layer 140 described with reference to FIG. 14. That is, there is no need to separately form a metal layer on the side surface of the substrate 105 in order to connect the first internal metal layer 141 and the second internal metal layer 142 each other. Therefore, since a total number of the operations is reduced, manufacturing cost may be saved and efficiency of a manufacturing operation may be increased.

The shape of the side internal metal layer 123A may be defined along with a shape of the plurality of through-holes H formed in the base substrate 101 in the exemplary embodiment illustrated in FIG. 12. That is, when the plurality of through-holes H have a circular or elliptic shape, the side internal metal layer 123A may be formed on a curved side surface of the substrate 105. When the plurality of through-holes H have a polygonal shape, the side internal metal layer 123A may also be formed on a side surface having a planar shape.

When the dividing operation illustrated in FIG. 17 is completed, the first terminal 120 and the second terminal 130 as in the exemplary embodiment illustrated in FIG. 1 may be formed by a plating operation using the first internal electrode 120A and the second internal electrode 130A as the seed layer. That is, shapes of the first terminal 120 and the second terminal 130 may be determined by the first internal electrode 120A and the second internal electrode 130A. Therefore, a portion of the side surface f the substrate 105 may be exposed from each of the first terminal 120 and the second terminal 130. In this case, the side surface exposed from each of the first terminal 120 and the second terminal 130 may have an area smaller than other side surfaces of the substrate 105 exposed between the first terminal 120 and the second terminal 130.

As set forth above, according to the exemplary embodiments, the resistor element capable of securing performance while reducing the number of manufacturing operations thereof may be provided.

Various advantages and effects of the inventive concepts are not limited to the description above, and may be more readily understood in the description of exemplary embodiments.

While exemplary embodiments have been shown and described above, it will be apparent to those skilled in the art that modifications and variations could be made without departing from the scope of the present invention as defined by the appended claims.

What is claimed is:

1. A resistor element comprising:

a substrate having a first surface and a second surface facing each other, and a plurality of side surfaces connecting the first surface and the second surface with each other;

a resistance layer on at least one of the first surface and the second surface; and a first terminal and a second terminal connected to the resistance layer, each including a first electrode layer on the first surface, a second electrode layer on the second surface, and a plurality of side electrode layers on at least a portion of the plurality of side surfaces, wherein at least a portion of the side surfaces of the substrate is exposed between side electrode layers of the first terminal, and wherein the resistance layer directly contacts the first electrode layer of the first terminal and the first electrode layer of the second terminal, or the resistance layer directly contacts the second electrode layer of the first terminal and the second electrode layer of the second terminal.

2. The resistor element of claim 1, wherein the first electrode layer, the second electrode layer, and the side electrode layers each include an internal electrode layer on the substrate, and an external electrode layer on the internal electrode layer.

3. The resistor element of claim 1, wherein the side surfaces include first side surfaces having a curved shape, and second and third side surfaces having a planar shape.

4. The resistor element of claim 3, wherein the second side surfaces and the third side surfaces are each disposed between first side surfaces.

5. The resistor element of claim 3, wherein each of the first side surfaces has an area smaller than each of the second and third side surface surfaces.

6. The resistor element of claim 3, wherein the second side surfaces have areas different from the third side surfaces.

7. The resistor element of claim 3, wherein each of the second side surfaces is exposed between the side electrode layers included in the first terminal.

8. The resistor element of claim 3, wherein each of the third side surfaces is exposed between the first terminal and the second terminal.

9. The resistor element of claim 3, wherein the side electrode layers are only on the first side surfaces.

10. The resistor element of claim 1, wherein the first electrode layer of the first terminal and the first electrode layer of the second terminal are disposed directly on the first surface, and the second electrode layer of the first terminal and the second electrode layer of the second terminal are disposed directly on the second surface.

11. The resistor element of claim 1, wherein the resistance layer is a metal layer which includes a metal, a metal alloy, or a metal oxide.

12. A resistor element comprising:

a substrate having a first surface and a second surface facing each other, and a plurality of side surfaces connecting the first surface and the second surface with each other;

a first terminal and a second terminal, each including a first electrode layer on the first surface, a second electrode layer on the second surface, and side electrode layers only on first side surfaces having a curved shape, among the plurality of side surfaces, to electrically connect the first electrode layer and the second electrode layer with each other; and a resistance layer on at least one of the first surface and the second surface so as to be connected to the first terminal and the second terminal, wherein there are no electrode layers on first side surfaces that do not have a curved shape, of the plurality of side surfaces, and wherein the resistance layer directly contacts the first electrode layer of the first terminal and the first electrode layer of the second terminal, or the resistance layer directly contacts the second electrode layer of the first terminal and the second electrode layer of the second terminal.

13. The resistor element of claim 12, wherein at least one of the side surfaces of the substrate is exposed between side electrode layers of the first terminal.

14. The resistor element of claim 12, wherein the first terminal includes an internal electrode layer on the substrate, and an external electrode layer on the internal electrode layer.

15. The resistor element of claim 14, wherein the internal electrode layer is provided as a seed layer for forming the external electrode layer.

16. The resistor element of claim 12, wherein the side surfaces include second side surfaces having a planar shape.

17. The resistor element of claim 16, wherein the second side surfaces having a planar shape are exposed to the outside.

18. The resistor element of claim 16, wherein each of the second side surfaces has an area greater than each of the first side surfaces.

19. The resistor element of claim 12, wherein the first electrode layer of the first terminal and the first electrode layer of the second terminal are disposed directly on the first surface, and the second electrode layer of the first terminal and the second electrode layer of the second terminal are disposed directly on the second surface.

20. The resistor element of claim 12, wherein the resistance layer is a metal layer which includes a metal, a metal alloy, or a metal oxide.

* * * * *